United States Patent [19]

Charmeux

[11] Patent Number: 4,684,940

[45] Date of Patent: Aug. 4, 1987

[54] FASTENING DEVICE OF ELECTROLUMINESCENT DIODES ON A SEALED DISPLAY TABLE

[75] Inventor: Gilbert Charmeux, Le Perreux-sur-Marne, France

[73] Assignee: Societe d'Etudes Techniques et d'Entreprises Generales, Paris, France

[21] Appl. No.: 580,105

[22] Filed: Feb. 14, 1984

[30] Foreign Application Priority Data

Feb. 18, 1983 [FR] France ..... 83 02722

[51] Int. Cl.[4] ..... G09G 3/00

[52] U.S. Cl. ..... 340/815.2; 340/815.14; 340/815.03

[58] Field of Search ..... 340/815.2, 815.03, 815.18, 340/753, 754, 782, 762, 815.04, 815.31, 815.14

[56] References Cited

U.S. PATENT DOCUMENTS

| | | | |
|---|---|---|---|
| 2,797,407 | 11/1985 | Greenlee et al. | 340/815.2 |
| 3,573,814 | 4/1971 | Lang | 340/815.04 |
| 3,681,552 | 8/1972 | Bailey | 340/815.18 |
| 3,879,725 | 4/1975 | Weber et al. | 340/815.04 |
| 3,918,053 | 11/1975 | Towne et al. | 340/815.03 |
| 4,271,408 | 6/1981 | Teshima et al. | 340/782 |
| 4,332,990 | 6/1982 | Stevens | 340/815.18 |

*Primary Examiner*—Marshall M. Curtis
*Attorney, Agent, or Firm*—Roland Plottel

[57] ABSTRACT

The invention concerns data display devices or synoptic panels. The principal object of the invention is to provide a fastening device for electroluminescent diodes on a sealed display table. In order not to impair or damage the seal of the said table, the diode is fastened on a diode carrier support in a guide which is fastened at the rear of the table. The invention applies especially to sealed display tables.

9 Claims, 5 Drawing Figures

FIG. 1
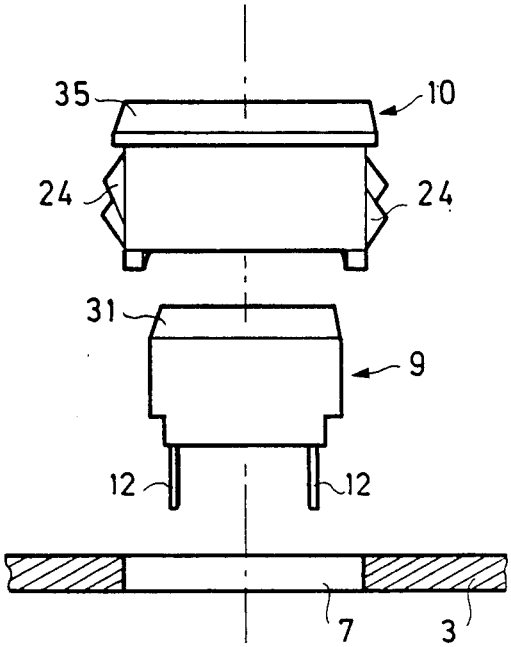
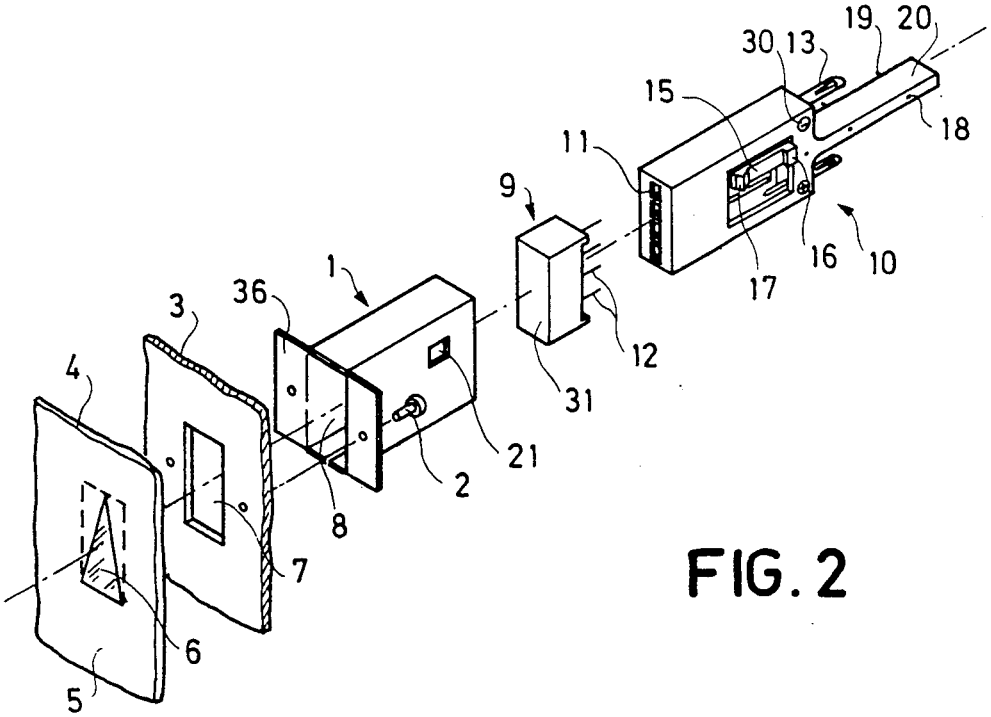
FIG. 2

FASTENING DEVICE OF ELECTROLUMINESCENT DIODES ON A SEALED DISPLAY TABLE

BACKGROUND OF THE INVENTION

The present invention concerns fastening or attachment devices for electroluminescent diodes on a sealed display table.

The optimalization of industrial processes often presumes intervention "in real time" (instantaneous) for various parameters. It is thus of prime importance to know data such as: the temperature of the pressure at one point in a process, the voltage difference or electric intensity, the opening or the closing of contacts, cut-out switches, circuit breakers, valves, the position of a switch, for example at railway points of a train; the running or stopping of the engines, alternators, ventilators or others. The display of such data is ensured especially by display tables or synoptic panels.

The reliability of such tables, in an industrial context which often presents very arduous conditions for the table material, demands that such tables be sealed. Thus display or measuring elements are protected against vapors, high temperatures and dusts.

In sealed display tables of the known type, luminous displays are often activated by glow-lamps, mounted at the rear of the tables. The glow-lamps present numerous drawbacks. Having a large surface like their supports, such does not allow their being mounted close to one another. Thus, for bulkiness reasons, they are not mounted on the optical visualization axis, which creates differences of luminosity according to the incidences under which they are observed. Furthermore, glow-lamps give off a considerable quantity of heat energy. In the devices of known type, depending on the number of glow-lamps, the cooling is carried out either by convection, with air inlet and outlet, or by forced air circulation. Further, the lifespan of the glow-lamps varies from 1500 to 5000 hours.

On the other hand, it is known to mount electroluminescent diodes on printed circuits. The printed circuit supporting the electroluminescent diodes is fastened, for example, by screws at the rear of the display table, without impairing its tightness. The positioning of the electroluminescent diodes is determined by data to be displayed. Thus this technique necessitates the creation of a new printed circuit for each display table. Furthermore, the electroluminescent diodes are no longer interchangeable to correct a diode failure or to change color following, for example, an improvement of the industrial process to be controlled. However, the lifespan of electroluminescent diodes is much longer than that of glow-lamps.

On the other hand, it is known to fasten the electroluminescent diodes by providing a hole in a display table. This embodiment presents the disadvantage of impairing the tightness of the display table. This type of embodiment is illustrated by FIG. 1.

The device according to the invention overcomes these drawbacks by allowing one to fasten an electroluminescent diode and by ensuring the electric supply at the rear of a display table. The invention is achieved by fastening the electroluminescent diode and its support in a guide which is itself fixed at the rear of the display table without impairing its tightness.

SUMMARY OF THE INVENTION

The principal object of the present invention is to provide a fastening device for a data display on a transparent sealed plate, wherein the device comprises a guide fixed at the rear of the plate and a support for display means fitting into the said guide, the display of the data being made through a transparent plate without the tightness of the plate to the display device being impaired.

BRIEF DESCRIPTION OF THE DRAWINGS

The invention will be better understood by means of reading through the following description and annexed figures, given by way of non-limitative example, among which:

FIG. 1 is a view of a device known in the prior art type;

FIG. 2 is a view in perspective of a device according to the invention;

DESCRIPTION OF THE PREFERRED EMBODIMENTS

Figure 3:
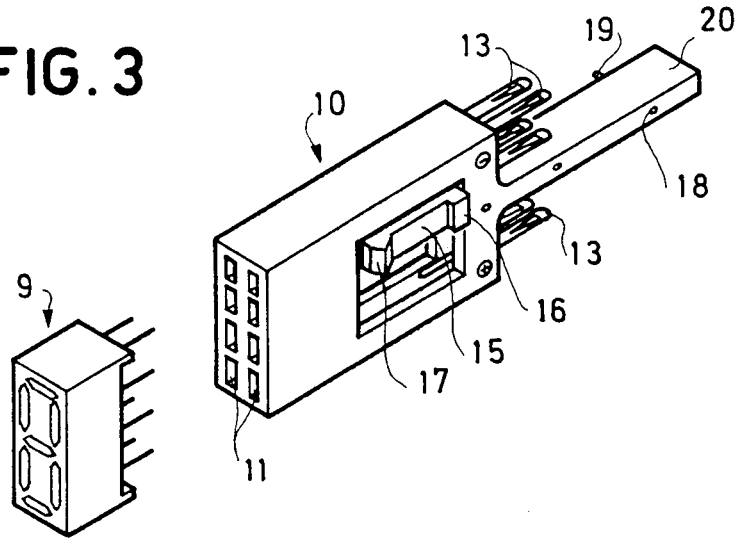
FIG. 3 is a view in perspective of an embodiment of the invention.

FIG. 1 represents an electroluminescent diode 9 comprising a radiating face 31 and two pins 12 connecting the electric supply. Diode 9 assembled at it support 10 is housed in a hole 7 provided in a plate 3 of the display table. The holding of the support 10 in the hole 7 is ensured by lugs 24.

FIG. 1, which represents the device, of a known type, necessarily grasps the hole 7. Therefore it cannot be rendered perfectly flush with plate 3 sealed. Furthermore, the housing 35 of the support 10 necessary for its attachment and its extraction extends from the plate 3 and forms a rough surface.

FIG. 2 represents a transparent plate 4 of polymethacrylate (the commercial name of which is "plexiglas") ensuring the seal of the display table. A plate 3, which is for example metallic, allows one to fasten together the different display elements of the display table. The metallic plate 3 comprises a hole 7 opposite of which is fixed the guide 1 for the electroluminescent diode carrier support 10. The guide 1 is presented in the form of a conduit adapted to the said support. The fastening is ensured, for example, by rivets 2 passing through holes provided in fastening clamps 36. The radiating face 31 of an electroluminescent diode 9 is placed at the level of the hole 7 of the metallic plate 3 by the face 8 of the guide 1. The diode 9 is electrically and mechanically connected to a diode carrier support 10 through the plugs 12 of the diode 9 and of the electric connectors 11 of the said support.

The diode 9/support 10 assembly fits inside the guide 1. A catch 17 borne by a clamp 15 of the support 10 ensures the locking of the said support in the hole 21 of the guide 1. An abutment 16 allows an exact positioning of the support. Plugs 13 allow one to connect the electric supply to the diode 9. Connections are established either by welding the supply wires, or by driving in female sleeves. Electric polarity references 30 are provided on the body of the support 10. A tail 20 extends from the guide 1 to facilitate the extraction of the electroluminescent diode carrier support 10. Lugs 19 and holes 18 allow one to assemble several supports 10 together in a single guide 1. This allows to obtain full advantage from the fact that the supports 10 present on the surface of the hole 7 substantially the same surface as the diodes 9. It is thus possible to implant numerous luminous dots at this surface. Plate 4 of polymethacrylate is covered on one of its faces with paint 5 so as to render more visible the data displayed by the display table. By using rectangular electroluminescent diodes 9 having a large surface or a mosaic of electroluminescent diodes, it is possible to obtain various forms of luminous displays, by operating a masking of one part of the surface of the diode. In the example represented in FIG. 2 the masking delineates a triangular luminous surface 6.

In the example of FIG. 2 the two central current connectors 11 are electrically connected to each other. The electroluminescent diodes device 9 in the illustrated case is composed of two diodes, thus disposed in series.

FIG. 3 represents a seven segment digital display 9, with electroluminescent diodes being fixed on an electroluminescent diode carrier support 10. The electric connectors 11 of the support 10 are adapted to the supply plugs of the display 9. A catch 17 ensures the locking of the support 10 in the hole 21 of the guide 1 or the FIG. 2. An abutment 16 allows an exact positioning of this support 10. Studs 19 and holes 18 allow one to assemble several supports 10 together in a single guide 1.

A tail 20 extends from the guide 1 in order to facilitate the extraction of the electroluminescent diode carrier support. Plugs 13 allow one to connect the electric supply of display 9. While FIG. 3 shows a display having seven diode segments, displays having nine segments as well as supports having dot matrix alphadigital displays do not depart from the framework of the present invention.

Figure 4:
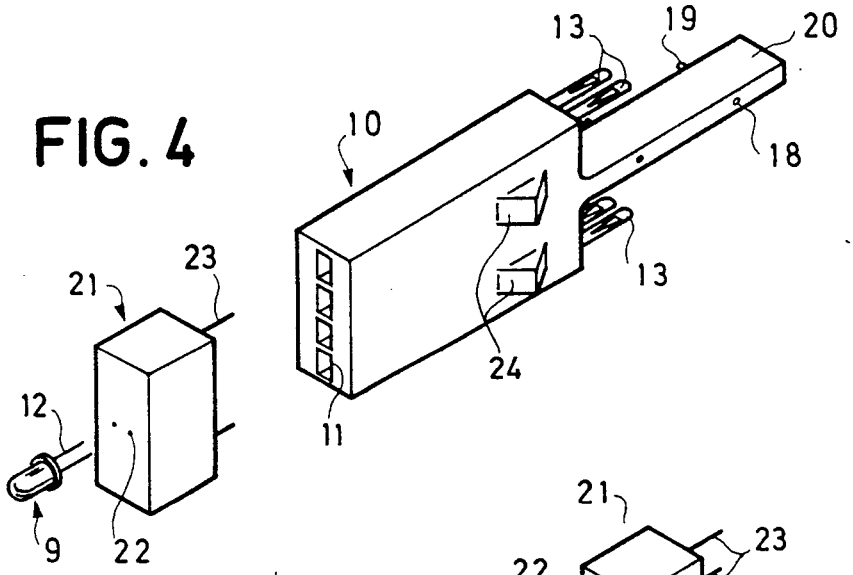
FIG. 4 is a view in perspective of another embodiment of the invention.

FIG.4 represents an electroluminescent diode carrier support 10, able to receive various types of electroluminescent diodes 9 through the intermediary of an adapter 21. The current connectors 22 of the adapter 21 are positioned in such a way as to be able to receive the electric supply plugs 12 of the electroluminescent diode 9. The plugs 23 of the adapter 21 ensure the electric connections by fitting inside the electric supply connectors 11 of the support 10. A support 10 provided with an adapter 21 and a diode 9 is forceably inserted in a guide of the type of the guide 1 represented in FIG. 2. The fastening of the support 10 in the guide 1 is ensured, for example, by lugs 24 of the support 10 cooperating with holes 24 in the guide 1. This type of fastening can also be applied to the embodiments illustrated by FIGS. 1, 2 and 3.

Figure 5:
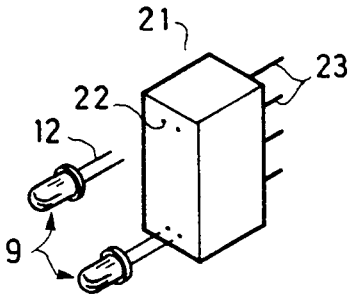
FIG. 5 is a view in perspective of a detail of FIG. 4.

FIG. 5 represents an adapter 21 allowing one to associate two round electroluminescent diodes 9 to a support not represented but identical to that represented as 10 in FIGS. 1–4.

The plugs 23 of the adapter 21 ensure electric connections with the support. Current connectors 22 of the adapter 21 are positioned in such a way as to receive the electric supply plugs 12 of the two electroluminescent diodes 9.

The present invention is not limited only to electroluminescent diodes supports. The device according to the invention also allows to fasten especially crystal liquid displays or galvanometers.

The invention applies to the display tables formed by the squaring technique. This technique consists in forming a display table by assembling elements of the same shape, for example, square.

The invention is not limited to the display tables shown. The device according to the invention also applies to control plates and more generally to any display device.

The device according to the invention, by adapting the fixed guide 1 and the removable support 10 of the electroluminescent diodes 9, presents numerous advantages over the known devices namely:

facility of extraction of the support 10 due to tail member 20;

possibility of forming a mosaic of electroluminescent diodes in a single guide 1 due to studs 19 and holes 18;

possibility of using different types of electroluminescent diodes 9 due to the adapter 21.

I claim:

1. A device for mounting a display means adjacent a plate means including a light transmissive sealed plate for display therethrough comprising at least one illumination means, wherein the device comprises a guide fixed at a face of said plate means, and a support, bearing said display means, and said display means and support being capable of slidably fitting into and out of said guide wherein said guide hold said display device in position therein in juxtaposition with said face on said transparent plate, whereby the display of the data is capable of being conducted through said transparent plate without the seal of the plate to said guide being impaired when an illuminescent means is replaced on said display means.

2. Device according to claim 1, wherein said device comprises between the support and the data display means, an adaptor means allowing an integral connection of the support with said data display means.

3. Device according to claim 1, wherein the display means are an electroluminescent diode.

4. Device according to claim 1, wherein the display means are a digital or alphadigital display device with electroluminescent diode.

5. Device according to claim 1, wherein the support of the display means comprises positioning means for said support in the guide.

6. Device according to claim 1, wherein the support of the display means comprises a tail extending from the guide.

7. Device according to claim 1, wherein the support fastens several display means side by side.

8. The device of claim 1 wherein said support comprises a plurality of sockets and plugs capable of electrically connecting said display means to an electricity supply source.

9. A display means comprising:

a display device;

a sealed plate forming a portion of a housing of said display means, said plate comprising at least one transparent area;

at least one guide fixed adjacent said transparent area of said sealed plate;

at least one support for said display device, said support fitting in said guide which retains said support such that said display device is retained adjacent said transparent area of said plate.

* * * * *